US009520646B1

(12) United States Patent
Nair et al.

(10) Patent No.: US 9,520,646 B1
(45) Date of Patent: Dec. 13, 2016

(54) DUAL-BAND COMPACT PRINTED CIRCUIT ANTENNA FOR WLAN USE

(71) Applicants: Deepu Vasudevan Nair, Thiruvananthapuram (IN); Varun Ramchandani, Kota (IN); Suresh Kumar Vagvala, Hyderabad (IN); Partha Sarathy Murali, San Jose, CA (US)

(72) Inventors: Deepu Vasudevan Nair, Thiruvananthapuram (IN); Varun Ramchandani, Kota (IN); Suresh Kumar Vagvala, Hyderabad (IN); Partha Sarathy Murali, San Jose, CA (US)

(73) Assignee: Redpine Signals, Inc., San Jose, CA (US)

( * ) Notice: Subject to any disclaimer, the term of this patent is extended or adjusted under 35 U.S.C. 154(b) by 142 days.

(21) Appl. No.: 14/311,261

(22) Filed: Jun. 21, 2014

(51) Int. Cl.

| | |
|---|---|
| ***H01Q 5/00*** | (2015.01) |
| ***H01Q 1/48*** | (2006.01) |
| ***H01Q 9/04*** | (2006.01) |
| ***H01Q 1/24*** | (2006.01) |

(52) U.S. Cl.
CPC ..... *H01Q 5/0027* (2013.01); *H01Q 1/243* (2013.01); *H01Q 1/48* (2013.01); *H01Q 9/045* (2013.01)

(58) Field of Classification Search
CPC ..... H01Q 1/48; H01Q 9/045; H01Q 5/0027
USPC ..... 343/702, 848
See application file for complete search history.

(56) References Cited

U.S. PATENT DOCUMENTS

| | | | | |
|---|---|---|---|---|
| 7,119,748 | B2 * | 10/2006 | Autti | H01Q 1/243 343/700 MS |
| 7,403,160 | B2 | 7/2008 | Chiang et al. | |
| 7,586,452 | B2 | 9/2009 | Li et al. | |
| 7,679,569 | B2 * | 3/2010 | Takaki | H01Q 1/243 343/702 |
| 7,742,006 | B2 | 6/2010 | Villarroel et al. | |
| 8,284,115 | B2 | 10/2012 | Nysen et al. | |
| 8,344,959 | B2 | 1/2013 | Autti et al. | |
| 8,587,481 | B2 * | 11/2013 | Lai | H01Q 1/243 343/700 MS |

(Continued)

OTHER PUBLICATIONS

Sun, Liu, Cheung, Yuk, "Dual-Band Antenna With Compact Radiator for 2.4/5.2/5.8 GHz WLAN Applications".

*Primary Examiner* — Dameon E Levi
*Assistant Examiner* — Ab Salam Alkassim, Jr.
(74) *Attorney, Agent, or Firm* — File-EE-Patents.com; Jay A. Chesavage

(57) ABSTRACT

A printed circuit antenna has a feedline region and a radiating structure region. The feedline region is formed of conductors on an upper plane, the conductors including a feedline which is edge coupled to a left ground structure and a right ground structure, all of which are above a ground plane. High-band RF is coupled from the RF feedline to a HB-U radiating structure including a first segment and a second segment perpendicular to the first segment, and also an HB-L radiating structure including a first segment coupled to a third segment through an air gap. Low-band RF is coupled across a gap from the first segment to a LB radiating structure having a third segment, a fourth segment, a fifth segment, a sixth segment, a seventh segment, an eighth segment, and a ninth segment with a terminus coupled to the left ground structure.

18 Claims, 3 Drawing Sheets

(56) References Cited

U.S. PATENT DOCUMENTS

| | | | | |
|---|---|---|---|---|
| 8,587,491 | B2 | 11/2013 | Badaruzzaman et al. | |
| 2005/0134509 | A1* | 6/2005 | Lin | H01Q 1/243 343/702 |
| 2006/0061512 | A1* | 3/2006 | Asano | G06F 1/1616 343/702 |
| 2006/0152411 | A1* | 7/2006 | Iguchi | H01Q 1/36 343/700 MS |
| 2007/0040752 | A1* | 2/2007 | Sinasi | H01Q 1/243 343/702 |
| 2007/0139280 | A1* | 6/2007 | Vance | H01Q 1/242 343/702 |
| 2012/0154222 | A1* | 6/2012 | Oh | H01Q 1/243 343/702 |
| 2012/0293376 | A1* | 11/2012 | Hung | H01Q 1/2266 343/702 |
| 2012/0313827 | A1* | 12/2012 | Kim | H01Q 1/243 343/702 |
| 2013/0076574 | A1* | 3/2013 | Rappoport | H01Q 1/243 343/702 |

* cited by examiner

*Figure 1*
Printed Circuit Dual–Band Antenna
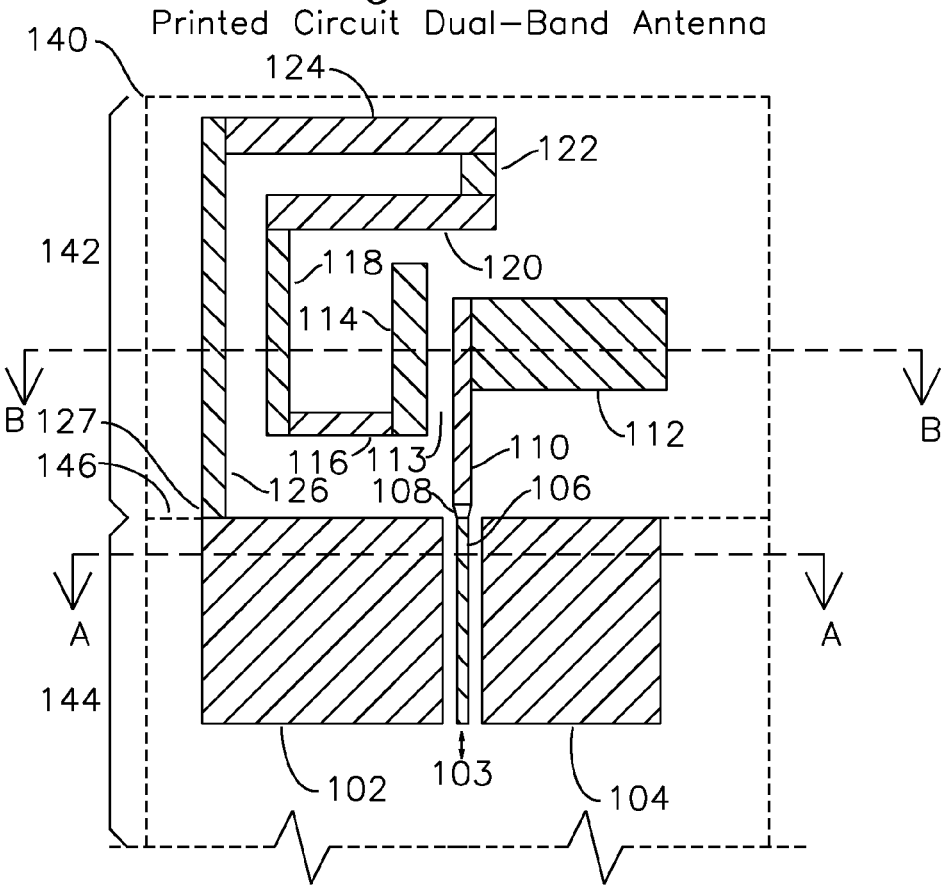
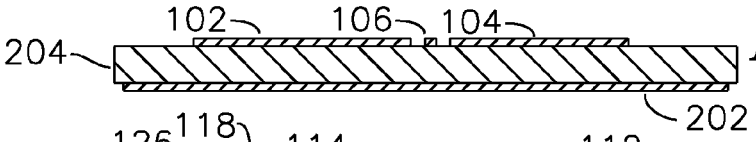
*Figure 2A*
Section A–A
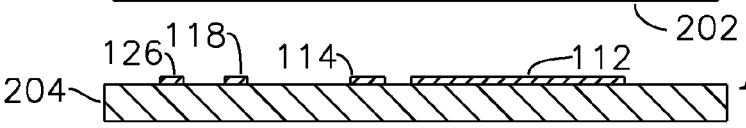
*Figure 2B*
Section B–B

DUAL-BAND COMPACT PRINTED CIRCUIT ANTENNA FOR WLAN USE

FIELD OF THE INVENTION

The present invention relates to an antenna structure. In particular, the invention provides an antenna structure suitable for use on a printed circuit board for Wireless Local Area Network (WLAN) use, where the antenna radiates over multiple frequency bands corresponding to desired WLAN frequency bands.

BACKGROUND OF THE INVENTION

Wireless Local Area Network (WLAN) stations and access points operate in at least one of the several WLAN frequency bands substantially centered about 2.46 GHz, 5.2 GHz, 5.5 GHz, and 5.9 GHz. Typically, each frequency requires a separate quarter wavelength antenna structure. In free space, a quarter wavelength for each of 2.46 GHz (Low Band, referred to herein as LB), 5.5 GHz (High Band Lower, referred to herein as HB-L), and 5.9 GHz (High Band Upper, referred to herein as HB-U) is approximately 31 mm, 13.4 mm and 12.7 mm, respectively. A printed circuit substrate such as FR4 has a permittivity $\in$ of 4.2 on one surface and free air on the other, so the lengths of the quarter wavelength shortens by a scaling factor of approximately $$\sqrt{\frac{\varepsilon+1}{2}},$$

or 62% of the free space wavelength. In the prior art, each antenna structure is implemented with a separate quarter wave radiating structure implemented on a conductive pattern printed on FR4 substrate. It is desired to provide a single radiating antenna structure for use with a plurality of RF frequencies for use in a LAN.

OBJECTS OF THE INVENTION

A first object of the invention is a printed circuit antenna having a feedline region and an antenna region, the feedline region including a feedline with a left grounded structure and right grounded structure on opposite edges of the feedline, the feedline region having an optional ground plane layer on a parallel planar layer, the feedline delivering RF to the antenna region, the antenna region having a high-band upper (HB-U) radiating structure, a high-band lower (HB-L) radiating structure, and a low-band (LB) radiating structure, the high-band (HB-U) radiating structure comprising a first segment which is an extension of the feedline in the antenna area, the first segment coupled to a second segment which is substantially perpendicular to the first segment, the low-band (LB) structure comprising a third segment which is parallel to, and edge coupled with, the first segment, the third segment coupled, in sequence, to a fourth segment which is perpendicular to the third segment, a fifth segment which is perpendicular to the fourth segment, a sixth segment which is perpendicular to the fifth segment, a seventh segment which is perpendicular to the sixth segment, an eighth segment which is perpendicular to the seventh segment, and a ninth segment which is perpendicular to the eighth segment and has a terminus end coupled to the left grounded structure, the HB-L radiating structure comprising the first segment coupled to the third segment across the gap.

A second object of the invention is a printed circuit antenna formed from a two-sided or multi-layer circuit board having a feedline region and a radiating antenna region, the feedline region formed from conductors on an upper plane separated from an optional lower ground plane by a dielectric, the ground plane present in the feedline region and not present in the antenna region including:

the feedline region including a feedline which is edge coupled to a left grounded structure on one edge and a right grounded structure on an opposite edge, the feedline region optionally including a ground plane on a lower or upper layer parallel to the feedline, a left grounded structure, and/or a right grounded structure, the feedline coupled to the antenna region;

the antenna region including:

- a high-band upper (HB-U) antenna part having a first segment which is coupled to the feedline through a transition structure, the first segment coupled to a second segment which is substantially perpendicular to the first segment;
  - a low-band (LB) antenna part comprising, in sequence:
    - a third segment which is substantially parallel to the first segment and also edge coupled to the first segment through a gap;
    - a fourth segment which is substantially perpendicular to the third segment, the fourth segment coupled to the third segment;
    - a fifth segment which is substantially perpendicular to the fourth segment, the fifth segment coupled to the fourth segment;
    - a sixth segment which is substantially perpendicular to the fifth segment, the sixth segment coupled to the fifth segment;
    - a seventh segment which is substantially perpendicular to the sixth segment, the seventh segment coupled to the sixth segment;
    - an eighth segment which is substantially perpendicular to the seventh segment, the eighth segment coupled to the seventh segment;
    - a ninth segment which is substantially perpendicular to the eighth segment, the ninth segment having one end coupled to the eighth segment and the opposite end coupled to the left grounded structure
- a high-band lower (HB-L) antenna part having the first segment coupled to the third segment across the gap.

SUMMARY OF THE INVENTION

A dual-band antenna suitable for printing onto a circuit board has a feedline region and an antenna region. The feedline region includes a feedline in a first plane which is referenced to a ground potential using any available combination of: a ground plane separated from the feedline by a dielectric; edge coupling to a left ground structure; and/or edge coupling to a right ground structure. The feedline and associated ground reference structures thereby provide a particular feedline impedance, such as 50 ohms. Beyond the extent of the feedline, left ground structure, and right ground structure is a radiating antenna region which contains radiating structures formed as electrically conductive segments without a ground plane below.

In one example of the invention, the feedline transitions over the edge of a ground plane to the antenna region, which includes a high-band antenna part formed by first segment and substantially perpendicular second segment, and a low-band antenna part formed by, in sequence, the substantially perpendicular sequence of segments formed by a third segment, fourth segment, fifth segment, sixth segment, seventh segment, eighth segment, and ninth segment. The third segment receives low-band RF through edge coupling to first segment, and the ninth segment has a grounded terminus.

BRIEF DESCRIPTION OF THE DRAWINGS

FIG. 1 is top view of a printed circuit antenna.

FIG. 2A is a cross section view of FIG. 1 at section A-A.

FIG. 2B is a cross section view of FIG. 1 at section B-B.

DETAILED DESCRIPTION OF THE INVENTION

Figure 3:
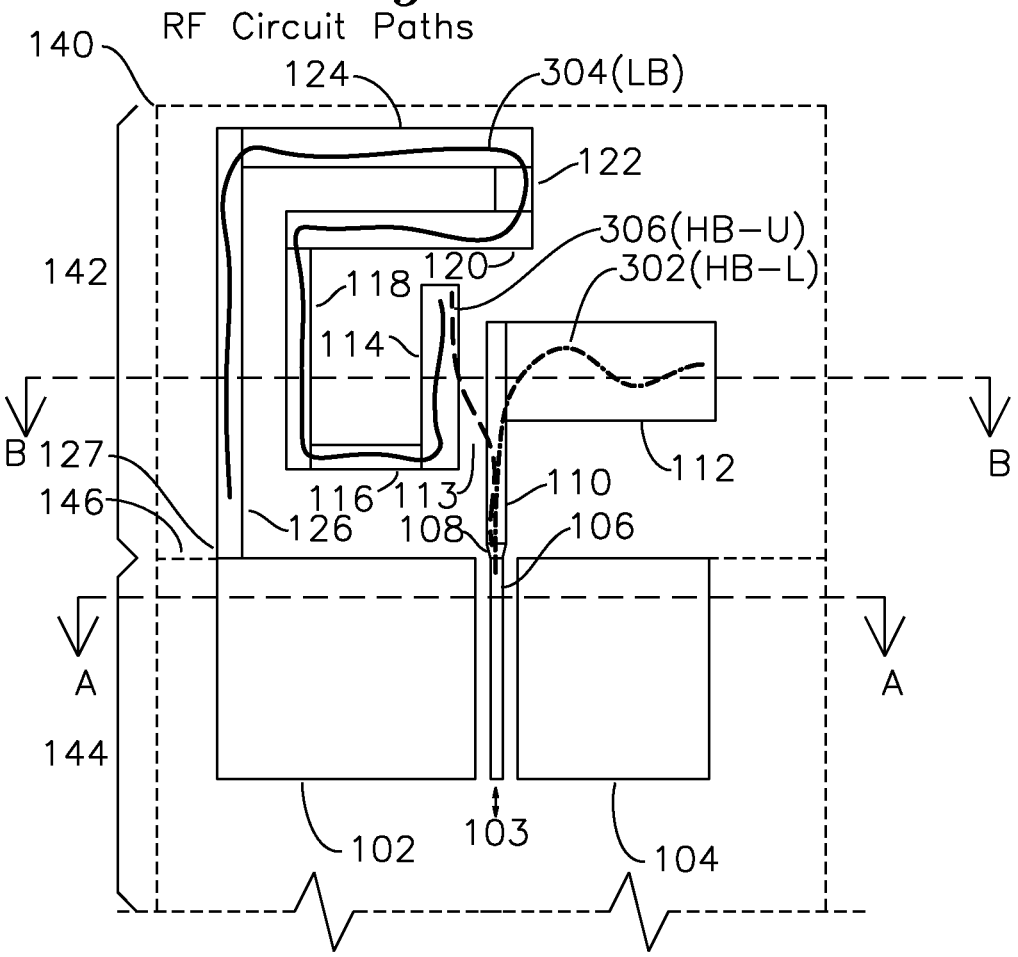
FIG. 3 is a diagram showing tri-band radiating paths for the antenna of FIG. 1.

FIG. 1 shows a printed circuit antenna 140 according to the present invention. The antenna comprises a feedline region 144 and a radiating region 142, which may be viewed in combination with FIGS. 2A and 2B showing the cross section view A-A and section B-B of FIG. 1, respectively. Feedline 106 is typically coupled to an RF transmitter/receiver (not shown) at 103, thereby coupling received RF signals from the antenna region structure to the receiver, and coupling RF from the transmitter to the antenna region structures. There are several techniques known in the prior art for forming a feedline, which has the characteristics of substantially constant impedance and return loss over a wide range of frequencies, when properly terminated. One type of feedline is known as a Co-Planar Waveguide (CPW), where feedline 106 is edge coupled to co-planar ground references such as co-planar left ground structure 102 and right grounded structure 104, both of which are at ground potential, but without ground plane 202 present on the plane below the feedline 106 plane. Another type of feedline is known as a co-planar waveguide with ground plane, shown with the addition of ground plane 202 of FIG. 2A in a conductor layer below, and parallel to, the feedline conductor 106 shown in FIG. 1, with the two planar conductor layers typically separated by a dielectric 204. Any type of feedline may be used to convey power to the radiating region 142, although in the present example, a grounded CPW is shown. When using co-planar feedlines, the grounded structures 102 and 104 may be used to provide ground potential to other structures, such as the terminus of ninth segment 126.

In the embodiment shown in FIGS. 1, 2A, and 2B, the feedline region 144 is formed of top layer conductors (102, 104, 106 in section A-A) such as by etching a copper layer on an upper plane and with a continuous ground plane conductor 202 on a lower plane separated by a dielectric layer 204. The ground layer 202 may be present on a bottom layer, or any intervening layer, in the case of a multi-layer PCB. The radiating region 142 does not have a ground plane below, as shown in section view B-B of FIG. 1 shown in FIG. 2B, and the structures in region 142 are either radiating RF structures or capacitive or inductive structures which provide coupling paths for RF which are quarter wavelength or half wavelength for the frequency of interest. Feedline 106 has a first edge which is coupled to left ground structure 102, and a second edge opposite the first edge which is coupled to right ground structure 104.

In one embodiment of the invention shown in FIG. 1, the antenna region 142 contains a high-band upper (HB-U) radiating structure and also a high-band lower (HB-L) radiating structure which together operate over a frequency range such as for 4.99 GHz to at least 6.0 GHz, the HB-U radiating structure consisting of first segment 110 and substantially perpendicular second segment 112, where the first segment 110 is an extension of the feedline 106 coupled through transition structure 108, and the second segment 112 is substantially perpendicular to the first segment 110. The HB-L radiating structure consists of first segment 110 coupling to third segment 114 through a gap 113. Antenna region 142 also contains a low-band (LB) radiating structure for the frequency range 2.37 GHz to 2.52 GHz comprising a third segment 114, fourth segment 116, fifth segment 118, sixth segment 120, seventh segment 122, eighth segment 124, and ninth segment 126, each particular segment of which is substantially perpendicular to a preceding segment and succeeding segment, with the third segment 114 parallel to, and edge coupled to, the first segment 110 which extends from feedline 106 through transition structure 108, and the ninth segment 126 coupled to the left grounded structure 102.

The high-band upper (HB-U) radiating structure comprises first segment 110 and second segment 112 along with the high-band lower (HB-L) structure which comprises first segment 110 coupled to third segment 114 through air gap 113. The HB-L and HB-U radiating structures together provide for radiation over the combined HB-L and HB-U frequency band. The HB-U and HB-L structures provide efficient RF radiation over the combined HB-U and HB-L frequency range from 4.9 GHz to at least 6 GHz or more. In one embodiment of the invention, the operating frequency band is defined as a frequency range where the well-known voltage standing wave ratio (VSWR) is less than 2:1 measured at the feedline input 103.

The low-band structure comprises third segment 114, fourth segment 116, fifth segment 118, sixth segment 120, seventh segment 122, eight segment 124, and ninth segment 126, and efficiently radiates at the low-band (LB) frequency about 2.46 GHz, where the low-band radiation frequency which may be considered to include at least the frequency range from 2.37 to 2.52 GHz. Alternatively, the frequency range for each of HB-U, HB-L, and LB may be specified in return loss measured at the feedline, with a VSWR less than 2:1 at the feedline input 103, as before.

FIG. 1 shows feedline 102 having several ground references, one of which is ground plane 202 through dielectric 204 (shown in FIG. 2A and FIG. 2B for sections A-A and B-B, respectively). Left ground structure 102 and right ground structure 104 both have a large surface area which is capacitively coupled or stitched with feed through vias to ground plane 202 through dielectric 204. Left ground structure 102 and right ground structure 104 are edge coupled to feedline 106. As previously indicated, ground plane 202 is present over feedline region 144, and is not present in radiating antenna region 142. Accordingly, feedline 106 crosses the edge of ground plane 202 at boundary 146 and thereafter feedline 106 becomes first segment 110, which in combination with second segment 112 forms a radiating structure for high band (HB-U) frequencies. In addition to radiating HB-U and HB-L frequencies, first segment 110 also couples low band (LB) RF across gap 113 to third segment 114, which couples energy into the LB radiating structure formed by the sequential arrangement of third segment 114, fourth segment 116, fifth segment 118, sixth segment 120, seventh segment 122, eighth segment 124, and ninth segment 126 has a terminus 127 which may be coupled to a ground reference such as ground plane 202 or left ground structure 102 a variety of ways, including direct attachment as shown in FIG. 1. In an alternative embodiment, the ninth segment 126 may terminate through a via to the ground plane layer at the ground plane 202 edge 146, however it is preferred to utilize a co-planar ground to avoid any parasitic inductance of a via to a non-coplanar ground layer.

In one embodiment, the dual-band radiator is formed from segment structures which perform functions as described below:

106—feedline with broadband frequency characteristics, referenced to ground plane 202 and adjacent left and right ground structures 102 and 104, respectively. Feedline 106 carries low-band (LB) and high-band (HB-U and HB-L) RF.

102 and 104—left and right ground structures, respectively. These provide edge coupling to feedline 106 and also optionally provide ground references to other structures, including the end of ninth segment 126.

108—transition segment for matching impedance of feedline 106 to first segment 110.

110—first segment, part of HB-U radiating structure with second segment 112 and part of HB-L radiating structure with third segment 114 through gap 113. First segment 110 also couples LB RF to fourth segment 114 through gap 113.

112—second segment, part of HB-U radiating structure.

114—third segment, part of LB radiating structure.

116—fourth segment, part of LB radiating structure.

118—fifth segment, part of LB radiating structure.

120—sixth segment, part of LB radiating structure.

122—seventh segment, part of LB radiating structure.

124—eighth segment, part of LB radiating structure.

126—ninth segment, part of LB radiating structure, terminating in grounded reference such as left grounded structure 102 or right grounded structure 104.

The structures of FIG. 1 may be sized to operate as radiating RF structures over the multi-band frequency ranges 2.46 GHz, 5.2 GHz, 5.5 GHz, and 5.9 GHz using an FR4 substrate with a dielectric constant of 4.2 and a dielectric thickness of 0.25 mm.

For highband-upper (HB-U) RF such as 5.9 GHz, feedline 106 couples RF to the HB-U radiating elements comprising first segment 110 and second segment 112.

For highband-lower (HB-L) RF such as 5.5 GHz, feedline 106 couples RF to the HB-L radiating elements comprising first segment 110 and third segment 114 across gap 113.

For a lowband (LB) radiation frequency such as 2.37-2.52 GHz, the physical dimensions of the third segment 114 through ninth segment 126 are selected to provide coupling of LB RF from first segment 110 across gap 113 to the LB RF radiating structure comprising third segment 114, fourth segment 116, fifth segment 118, sixth segment 120, seventh segment 122, eighth segment 124, terminating in ninth segment 126 with opposite end grounded such as by left ground structure 102 at terminus 127.

The conductor segments are typically formed from etching of copper cladding on an FR4 prepreg core during an etching process to provide the conductor geometries shown. Typical copper conductor thickness are in the range of ¼ oz copper to 1 oz copper, which defines a copper thickness according to the weight of copper per square foot, corresponding to a thickness range of 0.022 mm to 0.089 mm, respectively. Prepreg materials with a low loss tangent for the frequencies of interest are typically selected to reduce losses.

Figure 4:
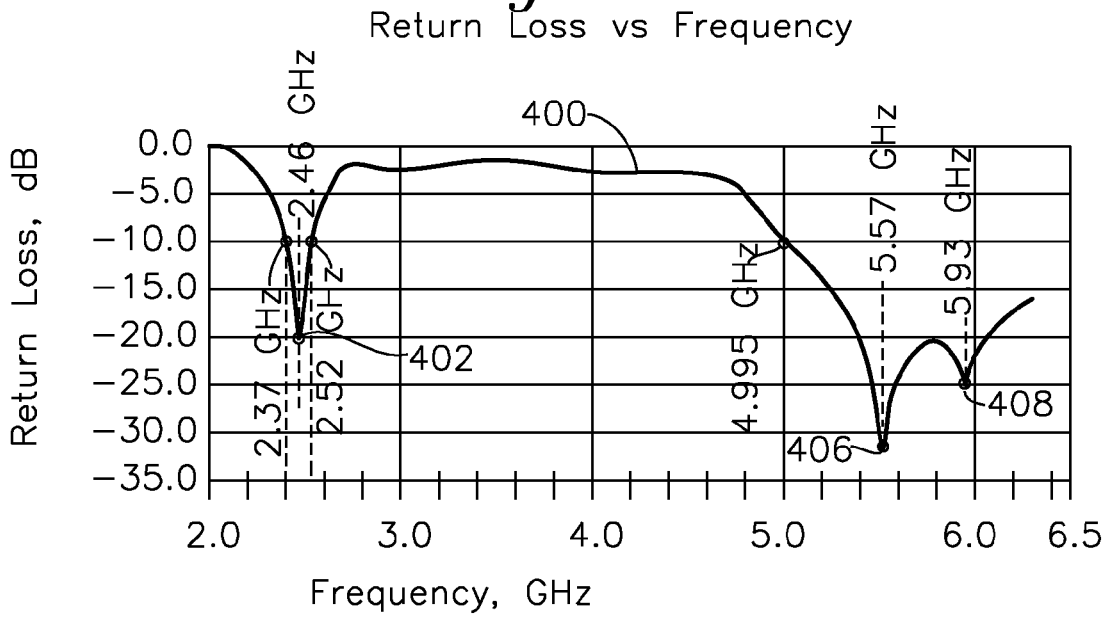
FIG. 4 is a plot of return loss versus frequency.

Without limitation of the scope of the invention, a series of dimensions is offered as an example, the design of which provides the return loss plot shown in FIG. 4. In this example, the various segments have the following lengths (segment long axis) and widths (segment short axis) with respect to the corresponding long and short axis shown in FIG. 1:

Left ground structure 102: 5.25 mm(W)×4.5 mm(H);

Right ground structure 104: 3.9 mm(W)×4.5 mm(H);

feedline 106: 4.5 mm×0.25 mm;

gap between first (left) edge of feedline 106 and left ground structure 102: 0.3 mm;

gap between second (right) edge of feedline 106 and right ground structure 104: 0.3 mm;

transition structure 108: 0.3 mm long, tapered to match width of feedline to width of first segment;

first segment 110: 4.5 mm×0.4 mm;

second segment 112: 4.25 mm×2.0 mm;

third segment 114 3.75 mm×0.75 mm;

fourth segment 116: 2.25 mm×0.5 mm;

fifth segment 118: 4.5 mm×0.5 mm;

sixth segment 120: 5.0 mm×0.75 mm seventh segment 122: 0.75 mm×0.9 mm;

eighth segment 124: 5.15 mm×0.8 mm;

ninth segment 126: 8.75 mm×0.5 mm;

Other arrangements of the elements of the HB-U radiating structure, HB-L radiating structure, and LB radiating structure are possible, but the example embodiment of FIG. 1 shows first segment 110 substantially parallel to feedline 106 and perpendicular to second segment 112. The LB radiator structure shown has third segment 114 substantially parallel to fifth segment 118, seventh segment 122, and ninth segment 126, all of which are and substantially perpendicular to fourth segment 116, sixth segment 120, and eighth segment 124.

FIG. 3 shows the RF circuit paths with respect to the segments described for FIG. 1. Path 302 shows the HF frequency path from feedline 106 to first segment 110 and second segment 112. Path 304 shows the LF frequency path from feedline 106 through first segment 110, across gap 113, and to the LB radiating structure formed by third segment 114, fourth segment 116, fifth segment 118, sixth segment 120, seventh segment 122, eighth segment 124 and ninth segment 126, as was previously described. An HB-L radiating structure is shown as 306, formed by the radiating structures first segment 110 and third segment 114 across gap 113.

FIG. 4 shows a return loss vs frequency plot with respect to the feedline 106. Plot 400 shows a return loss of approximately −20 db at 2.46 GHz at 402, and a −30 db return loss at 5.57 GHz at 406, and a −25 db return loss at 5.93 GHz at 408.

The proceeding has been a description of the preferred embodiments of the invention. It will be appreciated that deviations and modifications can be made within the scope of the invention. In particular, the following modifications may be made individually, or in combination:

a) placement of any of the radiating structures or individual segments of the radiating structures on layers other than the top layer;

b) reduction of the length of any of the segments of FIG. 1;

c) mirroring of one or more segments of FIG. 1 about an axis;

d) rotation of any one or more segments of a radiating structure.

e) changing a segment into additional meandering segments, for example changing (horizontal) second segment 112 into a sequence of a first horizontal segment followed by a perpendicular second segment which is shorter than the first horizontal segment, which is optionally followed by a second horizontal segment directed toward but not in contact with first segment 110.

Any of the above modifications may be made through compensation of the lengths or dimensions of other structures to maintain the frequency characteristics desired. Dimensions which are provided for each of the segments of the corresponding embodiments are for exemplar use with the particular frequency given, and it is understood that any dimensioned segment of the previously described radiation structures may be modified +/−20 percent of the stated dimension and still be usable for the specified WLAN frequencies. The term "substantially" with regard to dimensions is understood to mean +/−20 percent variation, and the term "substantially" with regard to parallel or perpendicular is understood to mean within 10 degrees of true parallel or perpendicular, respectively. the term "substantially" with respect to a particular frequency is understood to mean within +/−20 percent of the particular frequency. The scope of the invention is defined by the claims which follow.

We claim:

1. A dual-band printed circuit antenna for radio frequency (RF) and having:

a feedline region and a radiation region, the feedline region having an upper trace plane and an associated feedline ground reference structure;

said feedline region having said feedline conductor carrying RF in at least one of a high-band upper (HB-U) frequency, a high-band lower (HB-L) frequency which is lower than said HB-U frequency, or a low-band (LB) frequency which is lower than said highband (HB-L) frequency;

said feedline region having a first feedline conductor coupled to an HB-U radiating structure formed by a first segment coupled to a second segment perpendicular to said first segment;

said first segment also coupling said LB frequency to a third segment across a gap between common edges of said first segment and said third segment, said third segment coupled, in sequence, to a fourth segment, a fifth segment, a sixth segment, a seventh segment, an eighth segment, and a ninth segment having a terminus, said terminus coupled to said ground reference structure;

said first segment, said third segment, said fifth segment, said seventh segment, and said ninth segment substantially parallel to each other and also substantially perpendicular to said second segment, said fourth segment, said sixth segment, and said eighth segment;

said feedline conductor, said first segment, and said second segment forming a contiguous conductor which is separate from a contiguous conductor formed by said third segment, said fourth segment, said fifth segment, said sixth segment, said seventh segment, said eighth segment, and said ninth segment.

2. The printed circuit antenna of claim 1 where said feedline ground reference structure is at least one of a left ground structure or a right ground structure which is edge coupled to said feedline and coupled to a ground potential.

3. The printed circuit antenna of claim 1 where said LB frequency is in the range from 2.38 to 2.52 GHz.

4. The printed circuit antenna of claim 1 where said HB-U and said HB-L frequency range includes the range from 4.9 GHz to 6 GHz, over which said HB-U frequency range or said HB-L frequency range, said feedline conductor has a VSWR of less than 2:1.

5. The printed circuit antenna of claim 1 where said feedline return loss is less than −10 db over a first frequency range of 2.37 GHz to 2.52 GHz and also over a second frequency range of 4.9 GHz to 6.0 GHz.

6. The printed circuit antenna of claim 1 where said LB frequency is substantially 2.46 GHz.

7. The printed circuit antenna of claim 1 where said HB-L frequency is substantially centered around 5.5 GHz.

8. The printed circuit board antenna of claim 1 where said HB-U frequency is substantially 5.9 GHz.

9. The printed circuit board antenna of claim 1 where said feedline conductor is edge coupled to at least one of a co-planar left ground structure or a co-planar right ground structure without a ground plane reference on a different plane.

10. The printed circuit board antenna of claim 1 where said feedline region includes a co-planar left ground structure, co-planar right ground structure, and a ground plane that is not co-planar to said feedline.

11. The printed circuit board antenna of claim 1 where said HB-U structure first segment has dimensions of substantially 4.5 mm×0.4 mm, and said second segment has dimensions of substantially 4.25 mm×2.0 mm.

12. The printed circuit board antenna of claim 1 where said LB structure third segment has dimensions of substantially 3.75 mm by 0.75 mm, said fourth segment has dimensions of substantially 2.25 mm×0.5 mm, and said fifth segment has dimensions of substantially 4.5 mm×0.5 mm.

13. The printed circuit board antenna of claim 1 where said sixth segment has dimensions of substantially 5.0 mm×0.75 mm, said seventh segment has dimensions of substantially 0.75 mm×0.9 mm, said eighth segment has dimensions of substantially 5.15 mm×0.8 mm, and said ninth segment has dimensions of substantially 8.75 mm×0.5 mm.

14. A printed circuit board dual-band radiating antenna for RF having:

a feedline having an associated ground structure;

a LB radiation structure;

a HB-U radiation structure;

a HB-L radiating structure;

said HB-U radiation structure having a first segment coupled to said feedline, said first segment opposite end coupled to a second segment substantially perpendicular to said first segment;

said LB radiation structure having a third segment parallel to said first segment and separated from said first segment by a gap, said third segment perpendicular to and coupled to a fourth segment, said fourth segment coupled to and perpendicular to a fifth segment, said fifth segment coupled to and perpendicular to a sixth segment, said sixth segment coupled to and perpendicular to a seventh segment, said seventh segment coupled to and perpendicular to an eighth segment, said eighth segment coupled to and perpendicular to a ninth segment, said ninth segment having a terminus coupled to said ground structure;

said feedline coupled to said first segment;

said feedline conductor, said first segment, and said second segment being formed from a different conductor than said third segment.

15. The dual-band radiating antenna of claim 14 where said HB-U radiator first segment is substantially 4.5 mm×0.4 mm and said second segment is substantially 4.25 mm×2.0 mm.

16. The dual-band radiating antenna of claim 14 where said LB radiator third segment is substantially 3.75 mm×0.75 mm, said fourth segment is substantially 2.25 mm×0.5 mm, and said fifth segment is substantially 4.5 mm×0.5 mm.

17. The dual-band radiating antenna of claim 14 where said sixth segment is substantially 5 mm×0.75 mm, said seventh segment is substantially 0.75 mm×0.9 mm, said eighth segment is substantially 5.15 mm×0.8 mm, and said ninth segment is substantially 8.75 mm×0.5 mm.

18. The dual-band radiating antenna of claim 14 where said first segment, said third segment, said fifth segment, said seventh segment, and said ninth segment are substantially perpendicular to said second segment, said fourth segment, said sixth segment, and said eighth segment.

* * * * *